United States Patent [19]

Weber et al.

[11] 4,187,079

[45] Feb. 5, 1980

[54] METHOD FOR PRODUCING FORM COKE

[75] Inventors: Heinrich Weber, Recklinghausen; Kurt Lorenz, Hattingen; Horst Dungs, Herne; Karl-Heinz Wollenhaupt, Gelsenkirchen, all of Fed. Rep. of Germany

[73] Assignee: Firma Carl Still, Fed. Rep. of Germany

[21] Appl. No.: 941,016

[22] Filed: Sep. 11, 1978

[30] Foreign Application Priority Data

Sep. 13, 1977 [DE] Fed. Rep. of Germany ..... 2741075

[51] Int. Cl.[2] ..... C10L 5/00; C10B 53/04

[52] U.S. Cl. ..... 44/10 C; 44/10 H; 75/42; 201/5

[58] Field of Search ..... 44/10 R, 10 C, 10 H, 44/10 K; 75/42; 201/5

[56] References Cited

U.S. PATENT DOCUMENTS

| | | | |
|---|---|---|---|
| 2,089,061 | 8/1937 | Herglotz | 44/10 R |
| 3,172,823 | 3/1965 | John et al. | 44/10 C |
| 4,050,990 | 9/1977 | Lorenz | 44/10 C |

*Primary Examiner*—Carl F. Dees
*Attorney, Agent, or Firm*—McGlew and Tuttle

[57] ABSTRACT

A method for the production of form coke, such as coke for use in the smelting industry as blast furnace coke and also in electro-metallurgical facilities, comprising, coking a high volatile coal containing at least 35% volatile constituents so as to remove the volatile constituents to form a non-baking base coal, mixing a plurality of fine grain coal components together, of which at least one of the components comprises said non-baking base coal and at least one other component comprises a baking bituminous coal so as to form a mixture of such coals, subjecting the mixture to a degassing operation using highly volatile coals, coking the degassed mixture and pressing the coke into briquettes.

9 Claims, 2 Drawing Figures

METHOD FOR PRODUCING FORM COKE

FIELD AND BACKGROUND OF THE INVENTION

This invention relates to blast furnace fuel in general and, in particular, to a new and useful method of producing form coke for use, for example, in the smelting industry as a blast furnace coke and in electro-metallurgical facilities, by mixing several fine-grained coal components, of which at least one component is a nonbaking base coal and at least one other component is a baking bituminous coal, to obtain a mixture, subjecting the mixture to a degassing operation using highly volatile coals, and coking and hot-briquetting the degassed mixture.

DESCRIPTION OF THE PRIOR ART

A method similar to the inventive method is known, for example, from German Pat. No. 1,671,377. According to the method of this invention, pressed blanks or fuel briquettes are made by hot-pressing a fine grained mixture of coals, all of which soften at pressing temperatures and have a temperature below the softening point, with a substance (inert material) which does not substantially soften at pressing temperatures, and heating the mixture high enough for the mixture to attain the temperature required for the subsequent pressing operation, with the mixture being subjected to a degassing operation. The degassing is carried out for between one and fifteen minutes and a degassing temperature of between 450° C. and 530° C. is so harmonized to each other that a reduction of the crude tar yield of the briquetting material to an amount of between 0.07 and 0.2% results at the moment of deformation.

One feature of this method is the heating of the two components of the mixture in a hot gas flow in such a manner that first the inert substance component is heated and, after its separation, the baking coal component is heated in the same hot gas flow.

In the method for the production of hot briquettes from non-softening solids and baking coal, according to German Pat. No. 1,915,905, the pressing operation takes place at temperatures between 430° C. and 540° C., and cooling of the briquettes is preceded by an annealing operation, the duration of which depends on the temperature. In addition to lean coal (inert substance), this method uses anthracite coal and, as before, the lean coal and then the baking coal is heated in the same hot gas flow.

At the present time, there is a tendency to expand the base of the coals usable for the production of form coke as much as possible, and highly volatile coals are already usable with the known methods and have been used as the base coal component. However, according to the state of the art, this is possible only after a costly immunizing pretreatment of the coals, while keeping significant portions of the volatile constituents intact. See Stahl and Eisen 92 (1972) No. 215, pp. 1039/44).

SUMMARY OF THE INVENTION

The present invention accordingly provides a method in which the costly pretreatment of the highly volatile coal is unnecessary and thus is avoided.

In accordance with the invention, highly volatile coal containing at least 35% volatile components is used as a non-baking base coal and the volatile constituents are removed from this coal by simple heating and coking prior to mixing with the baking coal.

It could not be foreseen that such non-baking coals containing high percentages of volatile constituents could be, after their degassing, a suitable component for mixing with baking coals and subsequent pressing into briquettes of great local compressive strength. However, on the basis of available experiences, one would have to assume the contrary.

It is advantageous to use a bituminous coal of a low degree of internal condensation as the highly volatile coal. However, brown coal may also be used. Coke blanks of brown coal alone can be obtained according to one method proposed. However, this requires that extensive technical safety precautions be observed and that special equipment be used. See German DT-OS No. 2,507,735. It has proven to be expedient, within the scope of this new method, to bring the coke from the highly volatile base component to a grain size of 80% below 5 mm and to a temperature of between 600° C. and 900° C. before mixing it, and to bring the baking bituminous coal component to a similar grain size and to a temperature of between 200° C. and 350° C.

A particularly advantageous embodiment of the invention is one in which the heating of the anthracite or brown coal takes place in the same hot gas flow in which the baking bituminous coal is also heated for the mixture.

Accordingly, it is an object of the invention to provide an inexpensive method of using highly volatile coal for blast furnaces and electro-metallurgical furnaces.

Another object of the invention is to provide a method for producing form coke which comprises mixing a plurality of fine grain coal components together, with at least one component being a non-baking base coal which comprises a highly volatile coal containing at least 35% volatile constituents which are removed first by coking, together with at least one other baking bituminous coal in order to form a mixture, subjecting the mixture to a degassing operation, coking the degassed mixture and pressing the coke into briquettes.

A further object of the invention is to provide a method which is inexpensive to carry out and provides an economical and highly desirable end product.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
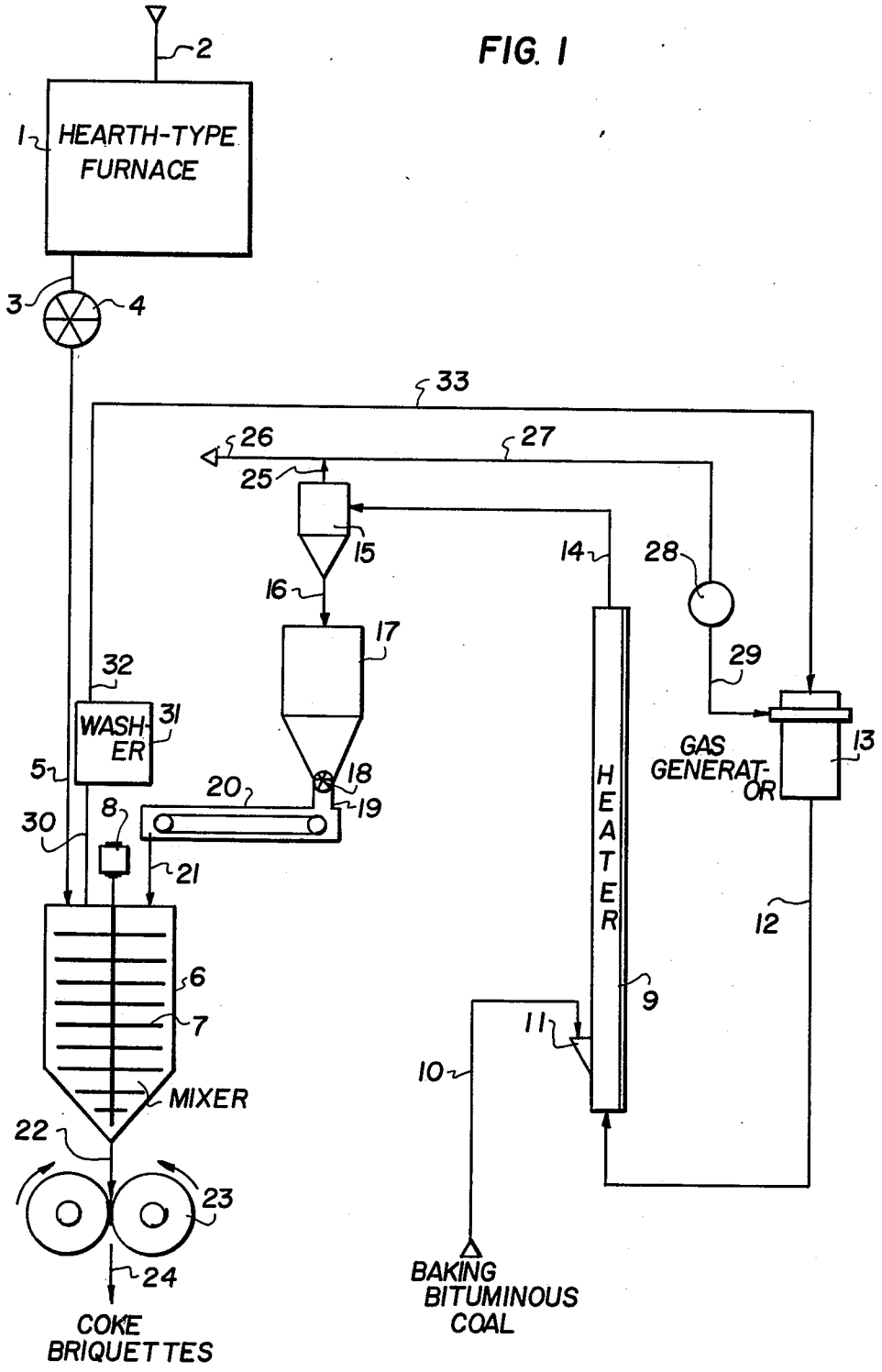
FIG. 1 is a schematic diagram of an apparatus for carrying out the method for the production of form coke in accordance with the invention.

Referring to the drawings in particular, the invention embodied therein in FIG. 1, comprises, an apparatus for forming coke briquettes using highly volatile coal. In the example shown in FIG. 1, a brown coal coke to be mixed with the baking coal has a relatively low temperature of, for example, 600° C. This is about the lowest temperature usable for the purpose.

The hearth-type furnace 1 receives dry brown coal of 14% residual water content and 44% volatile constituents from the conveyor 2. The brown coal is heated, dried and degassed in the hearth-type furnace to a residual content of 3% volatile constituents. Every hour, 21,000 kg brown coal coke of a grain size of 80% up to 5 mm and a temperature of 600° C. leave the hearth-type furnace through a line 3 and through a bucket wheel gate 4 and a line 5, and reach a mixer 6 with the mixing device 7, whose mixing or rabble arms are driven by a drive system 8.

Additionally, every hour, a flue gas heater 9 receives a quantity of 9800 kg baking bituminous coal from the conveyor 10 and the gate 11 of the expansion grade 8, and the grain size 0 mm to 10 mm. Its water content is 8%, its ash content (wf) 6.5% by weight and its content of volatile constituents (waf) 23% by weight. The flue gas heater receives hourly, 17,000 $Nm^3$ hot gas of 800° C. from the hot gas generator 13 through the line 12 and, in the heater 9, the gas flow has a velocity of 25 to 35 m/sec and a pressure of 500 mm water column. The coal is heated to 350° C. in the flue gas heater 9 and is crushed by the spontaneous evaporation of the moisture content and fed through line 14 to the separator 15 in which coal and dust are separated from the gas flow.

The separated coal reaches the bin 17 through the line 16 and arrives on the belt scale 20 through the bucket wheel gate 18 and a line 19. The belt scale 20 delivers 9000 kg baking coal of 350° C. to the mixer 6 through the nipple 21 hourly, where it is mixed with the fine coke from nipple 5. This results in a mixture temperature of 480° C., and the finished mixture is discharged from the mixer funnel after 10 minutes at 480° C., and then it drops through a line 22 into the roller press 23. 29,130 kg form coke of a 6% by weight residual content of volatile constituents and a temperature of 480° C. are discharged through a line 24 every hour, hardened in a known manner and made available for use. After hardening, the local compressive strength of the formed coke blanks is 250 kp.

Hot gas of 450° C. and laden with water vapor discharges through a line 25 from the separator 15, of which 5130 $Nm^3$ are dismissed into the open through line 26. The other part of the hot gas, i.e., 12,840 $Nm^3$, is returned through line 27, blower 28 and line 29 to the hot gas generator 13 and then through line 12 to the flue gas heater 13. 870 kg dust, tar and gas of high caloric value of 480° C. discharge hourly from the mixer 6. The gas is freed of its foreign matter in a washing system 31, and 260 kg purified rich gas of a caloric value of 5500 Kcal/$Nm^3$ discharge through line 32 to be fed through line 33 to the hot gas generator 13 and it provides heat up to 47% of its heat requirement.

Figure 2:
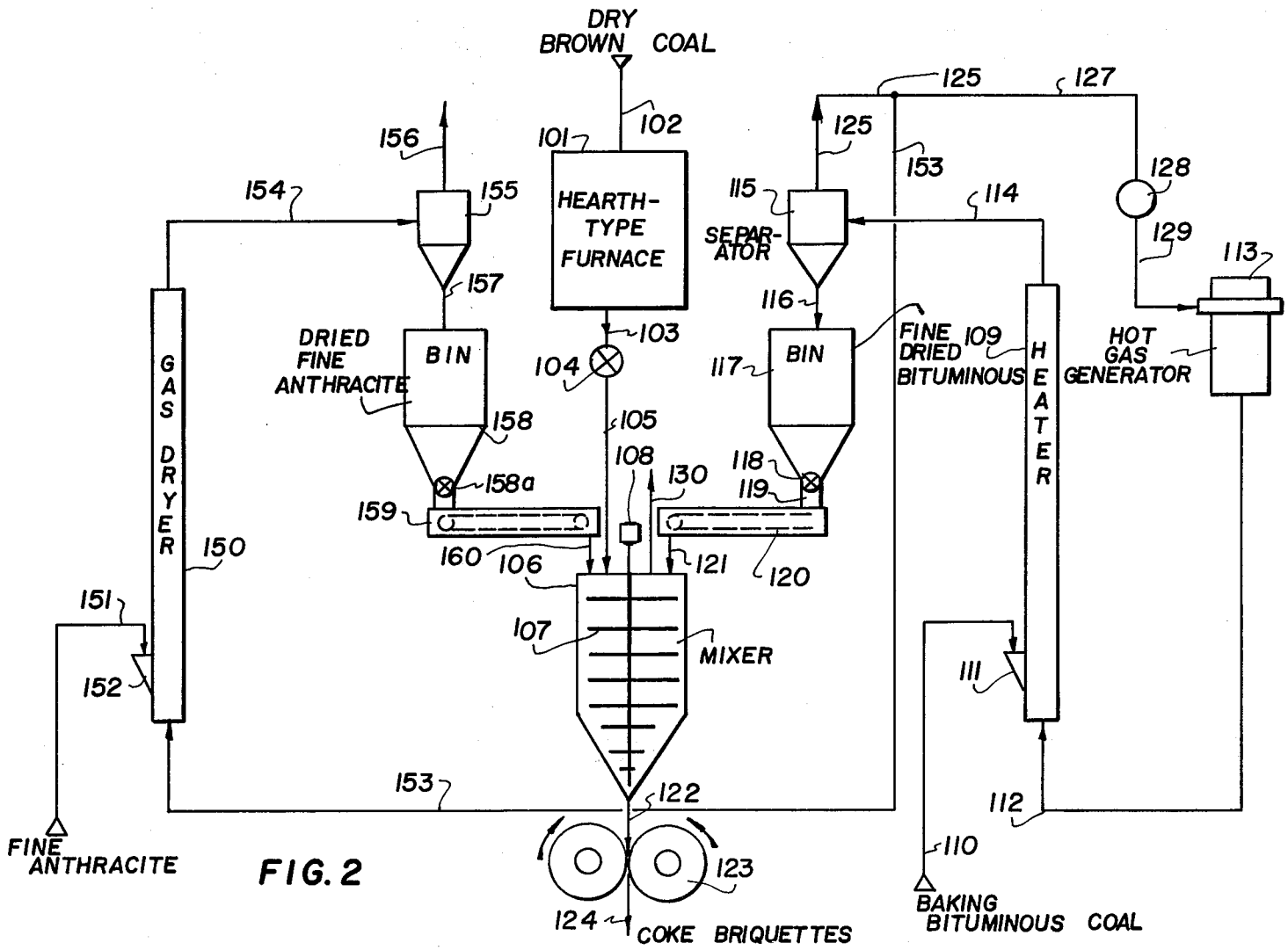
FIG. 2 is a view, similar to FIG. 1, of another embodiment of the invention.

In the second embodiment for example shown in FIG. 2, brown coal coke of a higher temperature, for example, 775° C., is supplied to a mixer 107, and excess heating gas from the flue gas heater is utilized for the baking bituminous coal component to preheat a second lean component, in this case, anthracite.

The hearth-type furnace 101 receives dry brown coal from the conveyor 102, as specified in Example 1. As explained in Example 1, the brown coal is heated, dried and degassed. 16,000 kg brown coal coke of 775° C. are removed every hour through a line 103 and reach the mixer 106 with the mixing device 107 and the drive system 108 through a bucket wheel gate 104 and a down chute 105. The flue gas heater 109 receives from a conveyor 110 and a gate 111 hourly, 9,800 kg of baking bituminous coal, as specified in Example 1.

In addition, the flue gas heater 109 receives 14,180 $Nm^3$ hot gas of 800° C. hourly from the hot gas generator 113 and, otherwise, the velocity and pressure conditions mentioned in Example 1 for the flue gas heater 9 are set in the flue gas heater 109. Fine coal heated to 300° C. is withdrawn through a line 114. The coal is separated from the gas flow in a separator 115 and transported through a line 116 into a bin 117 whence 9,000 kg of this coal of 300° C. reach a belt scale 120 through a bucket wheel gate 118 and line 119 and from there the mixer 106 through the nipple 121 every hour. The flue gas drier 150 receives hourly 5400 kg fine anthracite of an 8% water content through a conveyor 151 and a gate 152. In addition, it receives 4670 $Nm^3$ waste gas of 420° C. from the separator 115 hourly through lines 125 and 153. A gas velocity of 25 to 35 m/sec and a pressure of 150 mm water column are maintained in the flue gas drier 150.

The dried fine anthracite is transported through a line 154 into the separator 155 by the hot gas with a residual water content of 1% and a temperature of 100° C. It is separated therein from the hot gas which discharges from the apparatus through a line 156 with a temperature of 150° C. The dried fine anthracite reaches a bin 158 through a line 157. From there, 5000 kg hourly get to a belt scale 159 at 100° C. through a bucket wheel gate **158*a* and to a mixer 106 through a line 160. The three components are mixed in the mixer 106**, where a temperature of 480° C. prevails.

The non-baking components are "bound" by the baking components during the mixing operation, and the finished mixture, which is still at a temperature of 480° C., is discharged from the mixer after ten minutes through a line 122 and is supplied to a roller press 123. The mixture is then pressed at a pressure of 3.5 t/cm press working width, and the coke briquettes which are formed discharge from the equipment through the discharge 124.

The formed coke briquettes are post-hardened in a known manner and then have a local compressive strength of 250 kp. The blower 128 takes on 10,490 $Nm^3$ waste gas of 420° C. from a separator 115 through the lines 125 and 127 hourly and returns it through a line 129 to the hot gas generator 113 as circulation cooling gas. 260 kg rich gas of 5,500 kcal/$Nm^3$, which is heavily laden with dust and tar, leaves the mixer 106 every hour through a gas vent 130 on the mixer.

However, in a washing system (not shown) which is shown in Example 1, the gas is freed of its foreign matter and supplied to the hot gas generator 113 and covers up to 53% of the latter's heat requirements.

While specific embodiments of the invention have been shown and described in detail to illustrate the application of the principles of the invention, it will be understood that the invention may be embodied otherwise without departing from such principles.

What is claimed is:

1. A method for the production of form coke comprising: subjecting a highly volatile coal containing at least 35% volatile constituents to a coking in order to remove a substantial amount of the volatile constituents to form a non-baking base coal; mixing a plurality of fine grain coal components together, of which at least one is said non-baking base coal and at least one other comprises a baking bituminous coal in order to form a coal mixture; subjecting the coal mixture to a degassing operation; coking the degassed mixture to form a coke; and pressing the resulting coke to form briquettes.

2. A method for the production of form coke, as claimed in claim 1, wherein a bituminous coal having a low degree of internal condensation is used as the nonbaking, highly volatile coal component.

3. A method for the production of form coke, as claimed in claim 1, wherein brown coal is used as the nonbaking base coal component.

4. A method for the production of form coke, as claimed in claim 1, wherein the coke formed from the highly volatile coal component is used in a grain size of about 80% below 5 mm and is mixed with a baking bituminous coal.

5. A method for the production of form coke, as claimed in claim 1, wherein fine coke is heated to from 600° C. to 900° C. before it is mixed with said baking bituminous coal.

6. A method for the production of form coke, as claimed in claim 1, wherein the fine grained baking bituminous coal component is heated to from 200° C. to 350° C. before it is mixed with the fine coke.

7. A method for the production of form coke, as claimed in claim 1, wherein anthracite coal or brown coal in a grain size from 0 mm to 10 mm and in a quantity of from 10% to 40% relative to the nonbaking base coal component is added as an additional nonbaking coal component.

8. A method for the production of form coke, as claimed in claim 7, wherein the additional nonbaking coal component, namely, anthracite coal or brown coal, is brought into a grain size of from 0 mm to 10 mm and to a temperature of from 80° C. to 120° C. before being mixed with the other coal components.

9. A method for the production of form coke, as claimed in claim 7, wherein an additional, non-baking coal component, that is, anthracite or brown coal, is dried by the same hot gas flow by which the baking bituminous coal was heated.

* * * * *